US005269445A

United States Patent [19]

Tobler

[11] Patent Number: 5,269,445

[45] Date of Patent: Dec. 14, 1993

[54] DISPENSING DEVICE FOR FREE-FLOWING PREPARATIONS COMPRISING A REMOVABLE HEAD PIECE

[75] Inventor: Viktor Tobler, Oberdurnten, Switzerland

[73] Assignee: Supermatic Kunststoff A.G., Uster, Switzerland

[21] Appl. No.: 946,088

[22] Filed: Sep. 17, 1992

[30] Foreign Application Priority Data

Sep. 17, 1991 [CH] Switzerland ..... 02748/91

[51] Int. Cl.[5] ..... B67D 5/58

[52] U.S. Cl. ..... 222/211; 222/527; 222/567; 239/327

[58] Field of Search ..... 222/182, 153, 190, 211, 222/212, 215, 507, 519, 527, 566, 567, 568, 569, 570, 546; 239/327

[56] References Cited

U.S. PATENT DOCUMENTS

| | | | |
|---|---|---|---|
| 3,152,734 | 10/1964 | Berry | 222/211 |
| 3,176,883 | 4/1965 | Davis, Jr. | 222/211 X |
| 3,318,496 | 5/1967 | Ayotte et al. | 222/546 |
| 3,366,284 | 1/1968 | Marona et al. | 222/211 |
| 3,794,247 | 2/1974 | Corsette | 222/211 X |
| 4,437,587 | 3/1984 | Dvering | 222/211 X |
| 4,530,466 | 7/1985 | Rounkles et al. | 222/211 X |
| 4,836,422 | 6/1989 | Rosenberg | 222/211 X |
| 4,927,062 | 5/1990 | Walsh | 222/211 X |
| 5,048,750 | 9/1991 | Tobler | 222/519 X |
| 5,135,139 | 8/1992 | Krawagna | 222/519 X |

FOREIGN PATENT DOCUMENTS

| | | | |
|---|---|---|---|
| 181115 | 2/1955 | Austria | 222/211 |
| 0179738 | 4/1986 | European Pat. Off. . | |
| 0133983 | 9/1987 | European Pat. Off. . | |
| 567988 | 10/1957 | Italy | 222/211 |

*Primary Examiner*—Kevin P. Shaver

*Attorney, Agent, or Firm*—Oblon, Spivak, McClelland, Maier & Neustadt

[57] ABSTRACT

A container has on a neck portion thereof an external thread for a screw cap and, above the thread a sloping plane in the form of a spiral running around the outside of the container neck over an angle of 360 degrees. A head piece fitted into the container neck has a cylindrical part which bears on the inner side of the container neck and is held firmly on the container neck by a groove-bead connection formed on the outside of the cylindrical and on the inner side of the container neck. A cylindrical part of larger diameter, connected in one piece with the cylindrical part of the head piece, encloses the container neck on the outer side thereof and has on the inner side a sloping plane in the form of a peripheral spiral. The spiral surfaces lie on one another like the flanks of a thread. When the head piece is turned, therefore, the groove-bead connection is released by a wedge effect. The head piece can be removed for reuse of the container by being refilled. The head piece has a cup-shaped part which is connected in one piece at the center with the cylindrical parts and in which there are formed slit nozzles for the medium to be discharged.

9 Claims, 4 Drawing Sheets

DISPENSING DEVICE FOR FREE-FLOWING PREPARATIONS COMPRISING A REMOVABLE HEAD PIECE

BACKGROUND OF THE INVENTION

1. Field of the Invention

The invention relates to a dispensing device for free-flowing preparations.

2. Discussion of the Background

In the case of known devices of this type, the free-flowing preparation is contained in a container and is discharged from the latter by spraying, atomizing or by generating foam. An insert fitted into the container neck and a screwed-on cap have means especially designed for one of the above-mentioned types of discharge, such as distributor elements and a mixing chamber as well as the delivery path up to the outlet opening. A dispensing device of this type is known, for example, from EP-A-0 133 983.

If the container is to be reusable, the insert designed especially for spraying or foam formation, which must be seated firmly in the container neck during us of the container, must be removable from the neck. If the outlet opening for spraying or for discharging the foam is formed in the screw cap and the delivery path extends from the insert in the container neck into this screw cap, the screw cap which is only to be unscrewed for refilling the container can be used for the purpose of pushing the insert upwards out of the container neck with the aid of a so-called refill cam, which is formed on the inside of the screw cap and engages under the insert rim projecting slightly outwards at the top of the container neck. If, however, the screw cap serves only for transport protection and for tight, sealing and is to be unscrewed for any use, and, moreover, if the outlet opening is formed on a part closing the container neck at the top, the method mentioned above of making the container refillable by means of a refill cam on the screw cap cannot be used.

SUMMARY OF THE INVENTION

The present invention has the object of providing a dispensing device for free-flowing preparations which is simple and can be produced inexpensively, in which the container is refillable and, for this purpose, the part closing off the container at the top on the one hand is seated sufficiently firmly for use of the container, even when handled upside down, and on the other hand can be removed manually.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENT

The dispensing device comprises a container 1, of which only the portion 2 designed as a tilting neck and the container neck 3 adjoining thereto are represented in FIG. 1–FIG. 4. For the tilting-neck portion 2, bending lines 4 are formed of the same plastic material as the container, starting from one side and at various angles of inclination, which bending lines 4 make it possible to tilt the entire container neck to one side, which is of advantage for various applications, in particular when holding the container upside down. This principle is revealed in FIG. 19.

Figure 3:
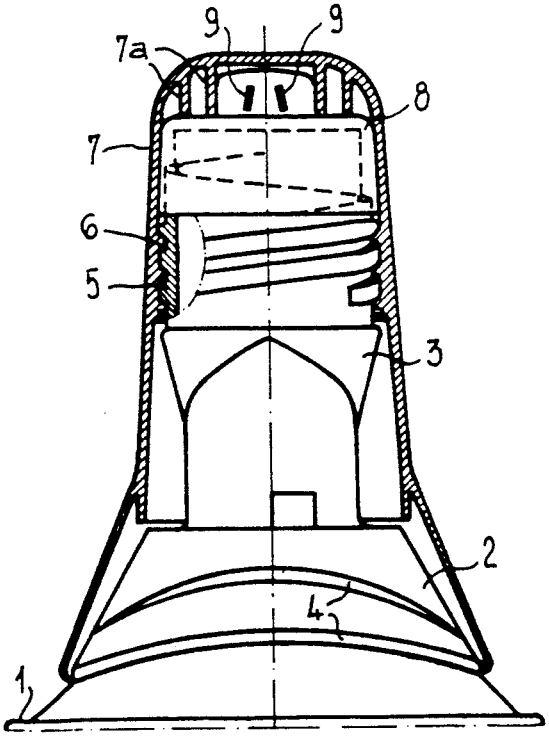
FIG. 3 shows the upper container part according to FIG. 1 with a screw cap.
Figure 4:
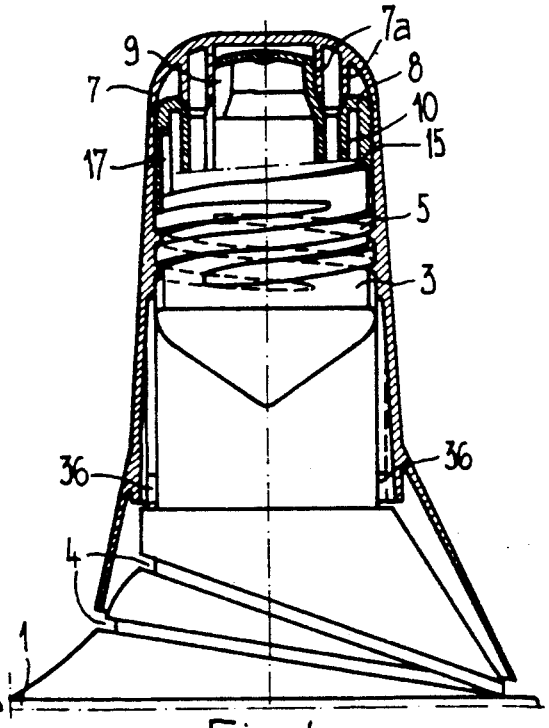
FIG. 4 shows the upper container part in a position turned 90 degrees with respect to FIG. 3, with the head piece being shown in axial cross-section.

The container neck 3 has in the central part thereof an external thread 5, which serves for screwing on a screw cap 7 provided with an internal thread 6 (FIG. 3 and FIG. 4). Above the thread 5, a head piece 8 is fitted onto the container neck 3. The head piece 8 closes off the container neck and has two slit nozzles 9 serving as an outlet opening. The outlet opening may also be designed differently: instead of the two slit nozzles being inclined slightly with respect to the center axis of the container 1, a slit nozzle running essentially transversely with respect to the center axis, a round or oval nozzle or a nozzle forming a U-shaped slit may be provided, for example, the cross-section of the outlet opening always being the same irrespective of the form of the nozzle.

In FIGS. 2, 4–7 and 8, the head piece 8 is shown in axial section. In order for the head piece 8 to be held firmly in the container neck 3, a groove-bead connection 10 is provided, more precisely, a peripheral bead 10*a* is formed on the inside of the container neck 3 and engages a peripheral groove 10*b* formed on a cylindrical part 11 of the head piece 8. On account of the adequately pliable plastic material of the parts, the groove-and-bead connection snaps in when the head piece 8 is fitted onto the container neck 3 and is then seated firmly. The head piece is expediently located in the screw cap when fitted on and is taken along when the screw cap is unscrewed, until the head piece snaps in. The groove 10*b* and the bead 10*a* can best be seen in FIGS. 7 and 8.

Figure 5:
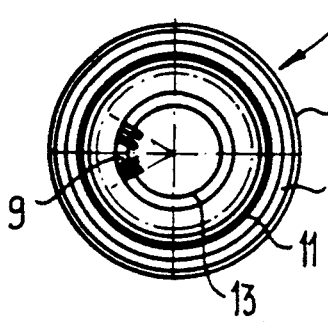
FIG. 5 shows a bottom view of the head piece.
Figure 8:
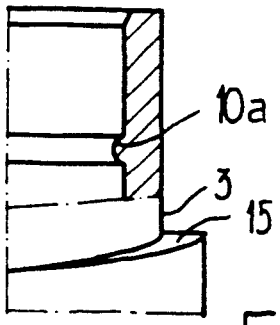
FIG. 8 shows the upper region of the container neck in the form of cutouts and on an enlarged scale.
Figure 6:
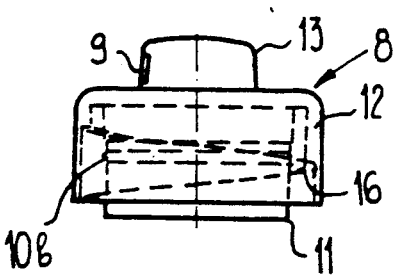
FIG. 6 shows a side view of the head piece.
Figure 7:
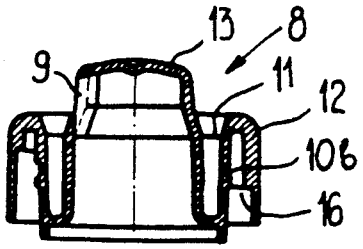
FIG. 7 shows an axial cross-section through the head piece.
Figure 9:
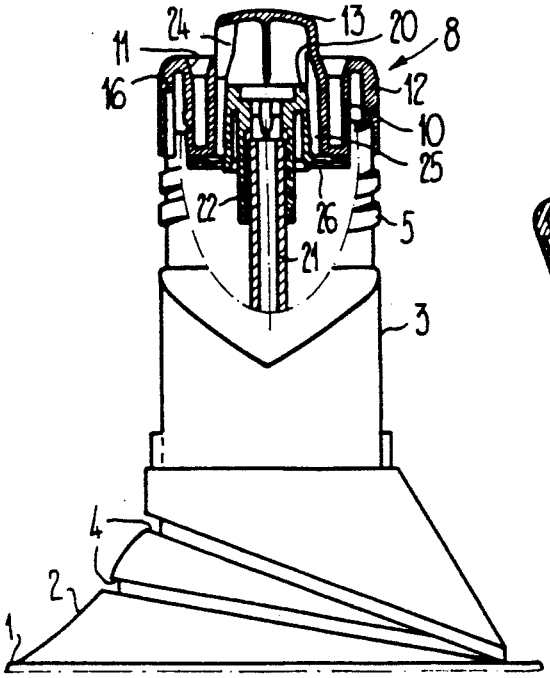
FIG. 9 shows the upper container section of a second embodiment of the dispensing device, represented partly broken away and with the head piece shown in axial cross-section.
Figure 10:
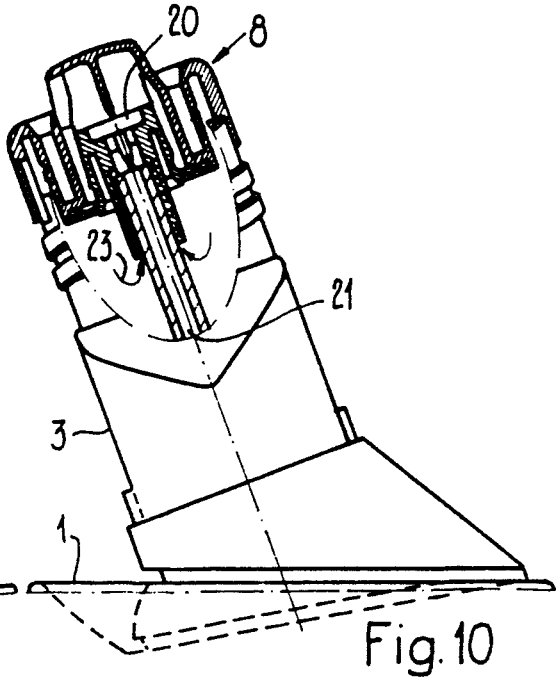
FIG. 10 shows the upper container section in a tilted position and turned 90 degrees with respect to FIG. 9.
Figure 11:
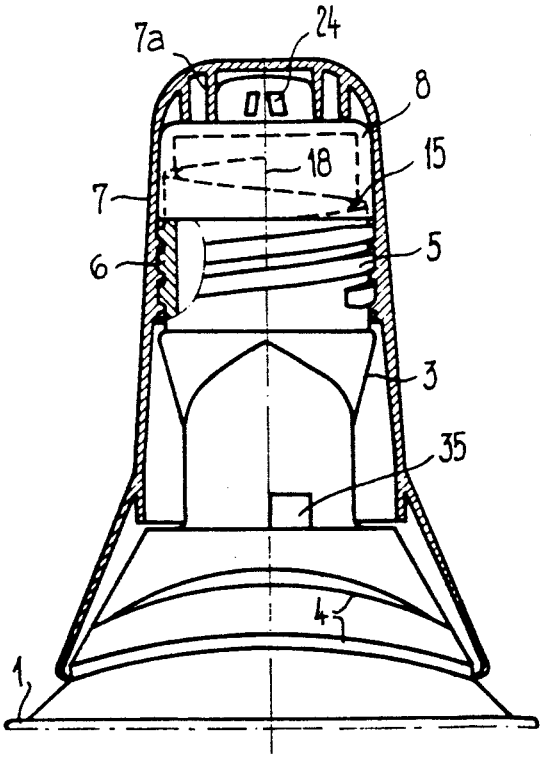
FIG. 11 shows the upper container section with a screw cap in axial cross-section.
Figure 12:
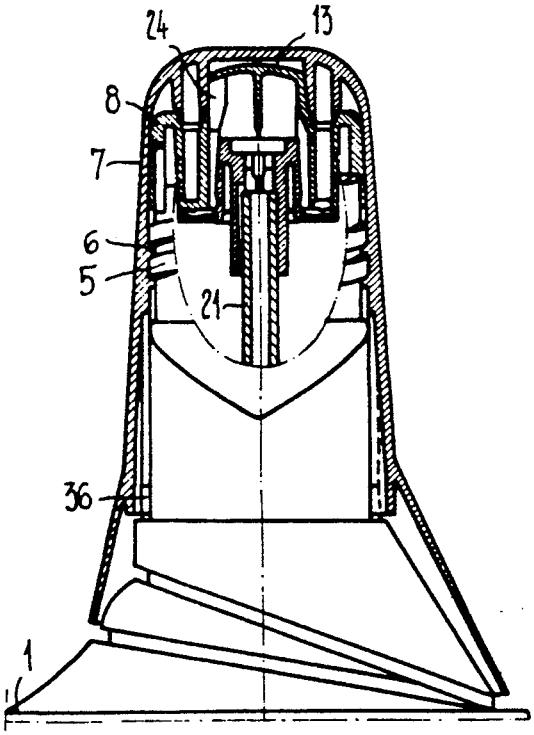
FIG. 12 shows the upper container neck with the screw cap and head piece in axial cross-section.
Figure 13:
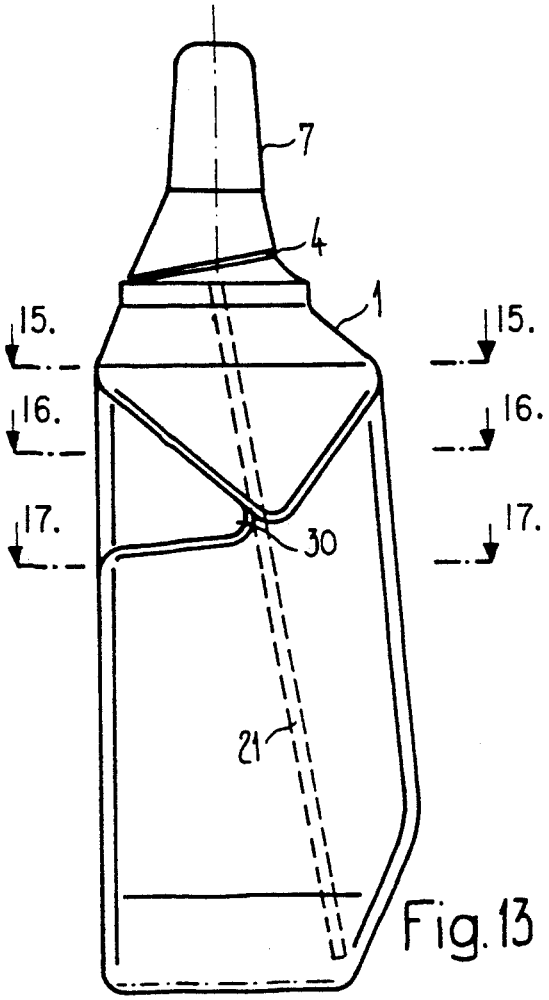
FIG. 13 shows a side view of the entire container in a second embodiment.
Figure 15:
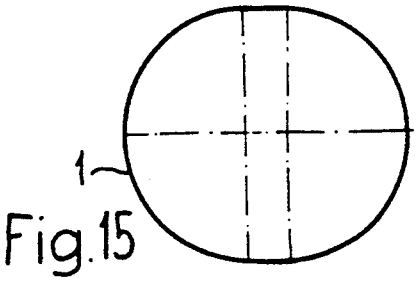
FIG. 15 shows a cross-section taken through the container along line 15—15 in FIG. 13.

The head piece 8, represented as a single part in FIG. 5–FIG. 7, has the already mentioned cylindrical part 11 with the peripheral groove 10*b* and a cylindrical part 12 of greater diameter connected in one piece with the cylindrical part 11, as well as a cup-shaped part 13 of smaller diameter, which is connected in one piece with the cylindrical part 11, projects beyond the two cylindrical parts 11 and 12, and has on its circumferential surface the two slit nozzles 9 or a differently shaped nozzle, as described in greater detail above. All the parts of the head piece 8 form a one-piece molded part. With the head piece 8 fitted onto the container neck 3, the outer cylindrical part 12 encloses the container neck 3 on the outer side.

Figure 1:
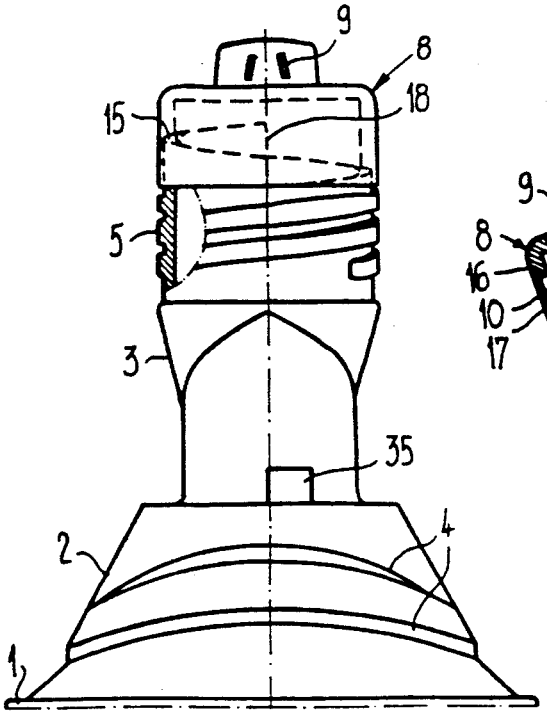
FIG. 1 shows the upper container part of a first embodiment of the dispensing device for spraying, with a head piece.
Figure 2:
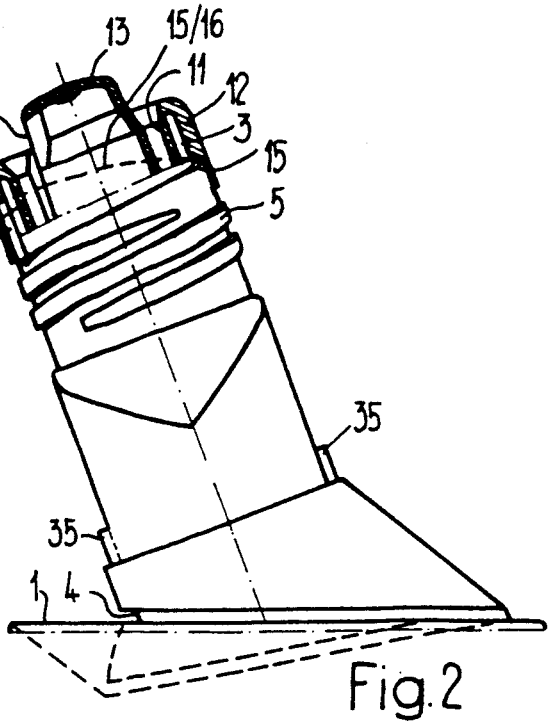
FIG. 2 shows the upper container part according to FIG. 1 turned 90 degrees, in a tilted position and with the head piece being shown in axial cross-section.

In order to be able to reuse the container 1 after emptying, for refilling the container the head piece 8 must be removed and, for this purpose, the groove-bead connection 10 must be released, which is intended to be possible only by a certain exertion of force, since the head piece must be sufficiently firmly seated in the container neck. Serving for removal of the head piece 8 is a first sloping plane 15, which is formed adjoining the container neck 3 above the thread 5 as can best be seen in FIG. 8, as well as a second sloping plane 16, which is formed on the inner side of the outer cylindrical part 12 of the head piece 8 and interacts with the sloping plane 15. FIGS. 1 and 3 reveal with respect to the container neck 3 and FIG. 6 reveals with respect to the head piece 8 that the sloping planes 15 and 16 are in each case designed as a peripheral spiral, the sloping planes lying one on the other like the flanks of a thread. These figures also reveal that these sloping planes are each designed as a spiral and extend over 360 degrees. This means that the starting point of the spiral and the end point of the spiral lie one above the other on a vertical line and, in FIG. 1 and FIG. 3, this line coincides with the center line of the container 1. This applies to the sloping plane 15 on the container neck 3 and also to the sloping plane 16 on the head piece 8. A narrow surface 17 on the cylindrical part 12 of the head piece 8, which surface lies in an axial plane, joins in stepped form the beginning and the end of the spiral along an axially parallel generatrix and, as can be seen in FIG. 2 and FIG. 4, forms the one stop surface which comes to bear against a surface 18 interacting with it, which surface is in precisely the same manner a surface joining the beginning and the end of the spiral 15 formed on the container neck 3, this surface 18 lying behind the center line of symmetry in FIG. 1. When they bear against each other, the two surfaces 17 and 18 form a stop for a turning position of the head piece 8 in which the groove-bead connection 10 assumes the position preventing axial movability. Since the screw thread 5, 6 and the two spirals 15, 16 have the same pitch, the head piece 8 can be brought into the correct position for snapping in of the groove-bead connection 10 with the aid of the screw cap 7.

The dispensing device for a free-flowing medium described above is advantageous in particular when the outlet opening in the head piece is formed by the two relatively narrow slit nozzles 9 which are formed a distance from each other, so that an angular area is exposed to the emerging liquid. The advantage is that, with the narrow slit nozzles, significantly less liquid is consumed than is the case with the previously known liquid containers of this type. At the same time, a flat jet is produced by this slit nozzle, which comes about in particular due to the fact that the cup-shaped part 13 has in the region of each slit nozzle 9 an inwardly increased wall thickness, as revealed in particular by FIGS. 5 and 7, so that the liquid jet is guided by this thickened rib-like wall. On account of the two slit nozzles which are present, an area to be cleaned can be swept over more quickly with the liquid jet, allowing liquid consumption to be reduced, which is also of particular significance with regard to environmental protection, particularly if a liquid for cleaning WCs or toilets is utilized, which should be used as sparingly as possible. Until now, for this type of cleaning use has also been made, inter alia, of so-called spout nozzles, which are, however, very complicated and expensive to produce.

In order that the liquid cannot escape from the slit nozzles 9 while the container is not in use or is being transported, the cup-shaped part 13 of the head piece 8 is enclosed by two sealing lips 7*a*, projecting downwards on the inner side of the screw cap 7, when the cap is screwed onto the container.

In the second embodiment of the dispensing device according to FIGS. 9–12, the principle is precisely the same as in the case of the first embodiment with respect to holding firm the head piece on the container neck with the aid of a groove-bead connection and with respect to the releasing of the head piece with the aid of sloping planes each designed as a spiral. The only difference is that this embodiment is intended for discharging foam, which is formed in the container during delivery by foaming of the contents by means of air pressure. For this purpose, the head piece 8, which is otherwise identically designed, has additionally in the cup-shaped part 13 an insert 20, into which there opens out a riser 21 which extends through the container 1 until close to the bottom thereof, shown in FIG. 19. When the container 1 is squeezed, a plurality of longitudinal gaps 22 located between insert 20 and riser 21 allow air to pass from the interior of the container via the liquid contained therein into the insert according to the arrows 23 in FIG. 10. The liquid is pumped through the riser 21 upwards into the insert 20. This insert 20 is designed in a known manner such that when the foamable liquid and the air are brought together foam is produced, which is then discharged through wider slit nozzles 24 formed in the cup-shaped part 13. The longitudinal gaps 22 through which the air present in the container passe into the insert 20 when pumping with the container, in order to cause foam to be produced in the insert, are too narrow to allow the air flow back into the container when it is no longer being squeezed to pass quickly enough into the container by this path. In addition, the foam would be sucked back along this path and result in clogging of the air path. Therefore, between the insert 20 and the inner wall of the cup-shaped part 13 there is a further wider annular gap 25, which is closed at the bottom by a one-piece membrane-like valve 26 when the container is squeezed, this valve 26 opening for the return air, which can then flow sufficiently quickly back into the container.

Figure 19:
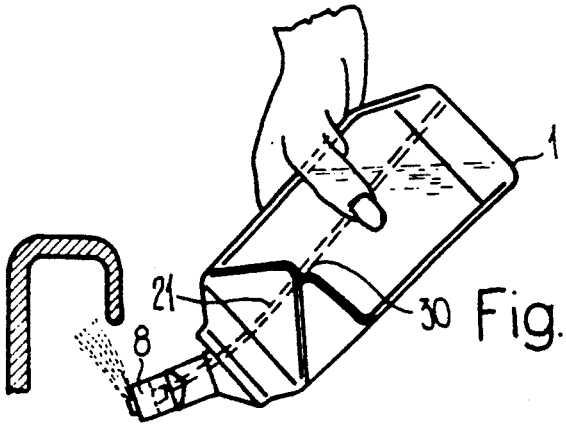
FIG. 19 shows the container in use in an upside-down position.

If the container is held upside down according to FIG. 19, the flow paths for the air and the liquid are changed over, i.e., the air then passes through the riser 21 and the liquid passes through the longitudinal gaps 22 into the insert 20.

Figure 16:
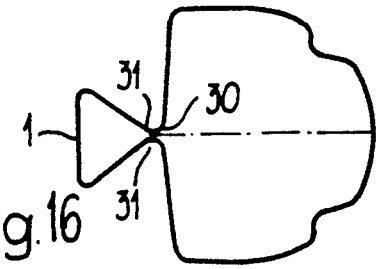
FIG. 16 shows a cross-section through the container along line 16—16 in FIG. 13.
Figure 17:
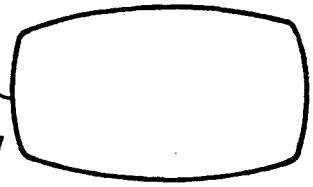
FIG. 17 shows a cross-section through the container along line 17—17 in FIG. 13.
Figure 14:
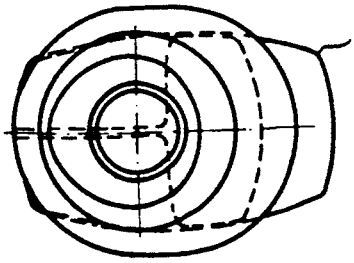
FIG. 14 shows the container according to FIG. 13, as seen from above.
Figure 18:
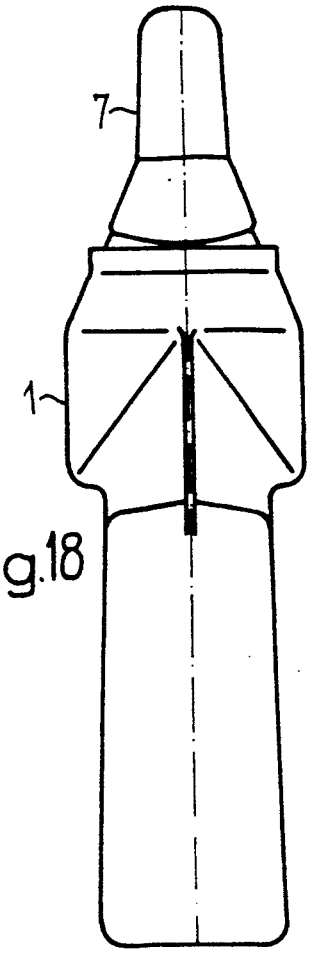
FIG. 18 shows a narrow side view of the container according to FIG. 13.

FIG. 19 also shows that, in the case of a container having a tilting neck, the riser 21 previously located in the center of the container would no longer be located in the container center in the position with the tilted-away neck if the riser were not firmly held within the container at least approximately in the center. A riser bearing against the inside of the downwardly pointing container wall in the case of upside-down use does not protrude beyond the liquid level in order that the air can be forced through the riser. Therefore, the container 1 has a supporting surface 30 which protrudes into the container center and against which the riser 21 bears in order to hold it approximately in the container center. The special shape of the container 1 with a supporting surface 30 is shown in FIGS. 13-18. FIG. 16 shows a cross-section through the container as taken along line 16—16 in FIG. 13. FIG. 16 reveals that the supporting surface 30 for the riser 21 is formed by a constriction 31 of the container, i.e., in one section of the container mutually opposite wall portions of the container are shaped in such a way that they lie closely opposite one another at the container center.

The dispensing device furthermore also has a child-proof lock, which is intended to prevent the screw cap 7 from simply being unscrewed. As FIGS. 1 and 2 reveal, below the thread 5 the container neck 3 is not cylindrical but oval and has on the outside in the region of greater diameter two cams 35 lying opposite each other, with an upwardly extending slope on one side. The screw cap 7 has on the inside lying opposite each other in each case a tooth 36, which, on account of the run-up slope of the cam, travels behind the latter when the cap is screwed on, so that the screw cap then can only be unscrewed if it is squeezed in a direction offset by 90° with respect to the teeth, in order to move the teeth outwards from the stop position towards the cams, so that the screw cap can then be turned.

Obviously, numerous modifications and variations of the present invention ar possible in light of the above teachings. It is therefore to be understood that within the scope of the appended claims, the invention may be practiced otherwise than as specifically described herein.

What is claimed as new and desired to be secured by Letters Patent of the United States is:

1. A dispensing device for free-flowing preparations, comprising:

a container for receiving a free-flowing medium to be discharged, said container having a neck and an end portion;

a head piece fixed on the neck and having a discharge opening;

a closure cap which covers the container neck and the head piece and which removably engages the container neck wherein an inner side of the container neck contacts a first part of the head piece and, inwardly from said end portion of the container neck, a peripherally formed and interengaging groove-bead connection is located on said container neck and said first part, said groove-bead connection including a catch for limiting axial mobility of the head piece and container neck relative to each other and wherein the container neck and said first part of the head piece enclosing the container neck include sloping planes which are interengaged such that, when the head piece is turned around the container axis, the head piece moves with respect to the container neck and the groove-bead connection is released so as to permit removal of the head piece.

2. A dispensing device as claimed in claim 1, wherein the sloping places comprise first and second spiral surfaces respectively formed on an outside portion of the container neck and on an inner side of said first part of the head piece enclosing the container neck and wherein the spiral surfaces bear against on another.

3. A dispensing device as claimed in claim 2, wherein the first and second spiral surfaces extend over an angle of 360° and wherein respective surfaces on the container neck and on the first part of the head piece enclosing the container neck lie in an axial plane, join in a stepped form the beginning and the end of a spiral along an axially parallel generatrix, and form a stop upon bearing against each other.

4. A dispensing device as claimed in claim 3, wherein the first part of the head piece comprise first and second coaxial cylindrical parts of different size diameters, connected in one piece, the first cylindrical part is fitted into the container neck and is firmly held on the container neck by means of the groove-bead connection and wherein the second cylindrical part is larger in diameter than said first cylindrical part, is provided on the inside with the first spiral surface, and encloses the container neck provided with the second spiral surface.

5. A dispensing device as claimed in claim 4, wherein the first cylindrical part of the head piece is connected in one piece to a cup-shaped part of smaller diameter and wherein said cup-shaped part protrudes beyond said first and second cylindrical parts and has an outlet opening formed thereon.

6. A dispensing device as claimed in claim 5, wherein the outlet opening comprises at least two slit nozzles spaced apart from each other in the cup-shaped part.

7. A dispensing device as claimed in claim 1, which comprises an insert and a flexible riser which protrudes centrally into a cup-shaped part of the head piece and opens out into said insert wherein said insert is arranged in the cup-shaped part, fluid in the container is pumped through said riser for forming foam, and wherein the container has, located a distance from the container neck, a supporting surface for the riser which supporting surface protrudes into an interior portion of the container, in order to hold the riser in a longitudinally center portion of the container.

8. A dispensing device as claimed in claim 7, wherein the supporting surface in the interior of the container comprises constricted wall portions of the container which are opposed to one another.

9. A dispensing device as claimed in claim 8, wherein the neck of the container comprises a tilting neck, which includes a plurality of peripheral bending lines in the container, starting from one side of the container at various angles of inclination, and wherein the container includes a restriction member formed on the same side of the container from which the bending lines start.

* * * * *